United States Patent [19]

Curtis

[11] 4,074,907

[45] Feb. 21, 1978

[54] INTERFITTING GAME BOARD AND PLAYING PIECES

[75] Inventor: James David Curtis, Santa Rosa, Calif.

[73] Assignee: James David Curtis, Santa Rosa, Calif.

[21] Appl. No.: 698,100

[22] Filed: July 19, 1976

[51] Int. Cl.[2] ..... A63F 3/00

[52] U.S. Cl. ..... 273/282; 273/273

[58] Field of Search ..... 273/135 R, 135 AC, 135 F, 273/135 AA, 136 R, 136 E, 137 R, 137 AC, 156

[56] References Cited

U.S. PATENT DOCUMENTS

| | | | |
|---|---|---|---|
| 1,085,941 | 2/1914 | Russell | 273/136 E |
| 1,518,178 | 12/1924 | Chefko | 273/136 E |

*Primary Examiner*—Richard C. Pinkham
*Assistant Examiner*—Arthur S. Rose

[57] ABSTRACT

A game apparatus comprising a square board with vertical, horizontal, and diagonal slots crossing in sixteen intersections, and twelve cubical playing pieces in six duplicate pairs distinguished by the different forms and arrangements of raised strips upon their plane surfaces which fit into the intersections of slots upon the board such that the cubical playing pieces rest freely movable without touching, so that they maybe easily arranged. The object of the game is to place all of ones share of the cubical playing pieces upon the board in such a manner that the confronting plane surfaces of cubical playing pieces resting upon the immediate intersections bear raised strips which agree with one another as an image in a mirror agrees with the object confronting it. There is a provision for the rolling of the cubical playing pieces during the game, and there are restrictions against turning them.

1 Claim, 20 Drawing Figures

INTERFITTING GAME BOARD AND PLAYING PIECES

BRIEF SUMMARY OF THE INVENTION

The "Stumbling Block Game" is a board game consisting of twelve cubical playing pieces and a board with 16 intersections of slots. It can be played by one or two persons or used a an educational tool for exceptional childern or adults with perceptual or motor disabilities. The game set may be constructed from hardwood, molded plastic, or any suitable material. It is a pleasant, fast moving game of skill and chance embodying tactile perception. This quality becomes particularly apparent during play when it is necessary to determine the arrangement upon all the sides of ones own playing pieces and all the pieces upon the board; one soon discovers that feeling the pieces is a quick, happy alternative to bending ones body about over the board.

Set up of game: In this game rotation of the cubes is prohibited except when rolling them, or after the reserve pieces not choosen at the beginning are exhausted when horizontal rotation is permitted, as will be explained further. (1) Shuffle all 16 cubes on the table. (2) Each player picks out four cubes at random, and sets them beside each other, in any order, in a row on his side of the board, so that they are square with the board, regardless of the designation of the faces.

To determine who sets the first "Stumbling Block" on the board: (1) Each player picks out one of the four cubes from his row and rolls it on the table, as in a dice game. (2) Whoever throws a cross () of an *x* (X) on the top of his cube when the other hasn't, gets to place his cube "The Stumbling Block" on the board, as nearly square with the board as his cube will lie. He may place "The Stumbling Block" on the board in any one of the sixteen intersections of the groves into which every side of any of the cubes will fit. (3) The other player returns his cube back into position on his side as nearly square with the board as his cube will lie.

To play the game: The object of the game is to place all of one's cubes on the board. (1) The player who returned his cube to its original position examines his four cubes to determine whether or not any side of his four cubes will match a side of the "Stumbling Block" on the board without rotating his cube.

If the player can play: (1) He picks up the cube with the matching side and places it without rotation beside the "Stumbling Block", so that the sides match as in a mirror. This concludes his turn. (2) The other player now examines the faces of his remaining cubes to see if any side of any one of his cubes will match a side of the cubes on the board without rotation. (3) If the players can play they continue to proceed as above. (4) All sides of every cube on the board must match the side of every cube which it squarely faces, unless there is an ufilled intersection between the cubes.

If a player cannot play: (1) The player picks out a cube from the boneyard and gives it to his opponent to roll on the table. After rolling the cube, he who rolled it squares it with the table. (2) The player then picks up that cube, and without rotating it attempts to match any side like in a mirror with any side of any of the cubes on the board. (3) If he still cannot play, he places the cube in a position in his row, without rotation, and his turn ends.

When the boneyard is exhausted: Horizontal rotation of the cube is permitted, but the cube cannot be turned over. (1) The player who cannot play asks for one of his opponents' cubes, and the opponent picks up a cube he cannot use and rolls it on the table. (2) The player may also go out by rolling his last cube to his opponent. Score is kept by counting the player's cubes which remain off the board when the other player has placed all of his cubes on the board. (3) The player with the least score after playing five times is the winner of the game. (4) When one player goes out by rolling his last cube to his opponent. The opponent may play as long as he can with the cubes he has left to reduce his score.

A solitaire game can be played by shuffling the cubes, dividing them into two rows, and rolling a cube from the row the player selects as his own, using it as the Stumbling Block. Then he would try to match all the cubes one after the other in any order as in the two handed game. If one can use up all the cubes in one's row, one wins.

BRIEF DESCRIPTION OF THE SEVERAL VIEWS OF THE DRAWING

FIGS. 1, 3, 5, 7, 9, and 11, show the front, left, and top sides of the cubical playing pieces viewed from their back, right, and bottom sides in FIGS. 2, 4, 6, 8, 10, and 12.

DETAILED DESCRIPTION

Figure 1:
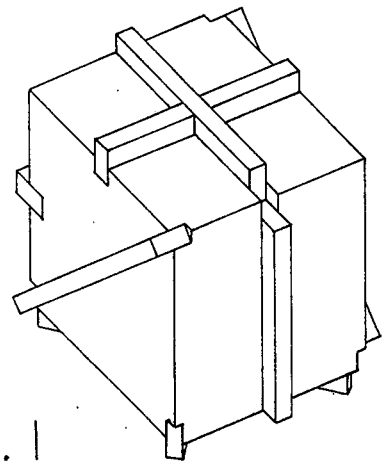
FIGS. 1, 2, 3, 4, 5, 6, 7, 8, 9, 10, 11, and 12. are isometric views of the six pairs of duplicate cubical playing pieces.
Figure 2:
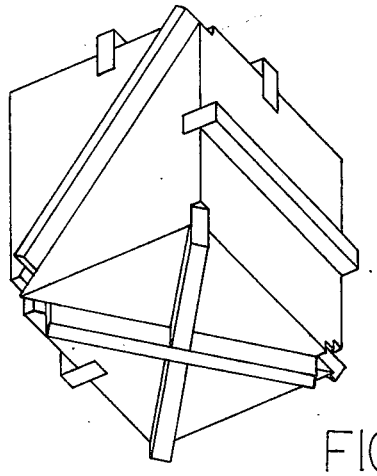
Figure 3:
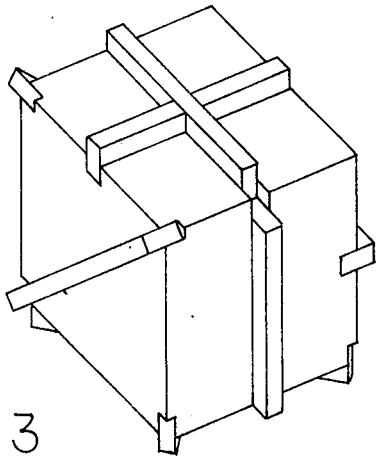
Figure 4:
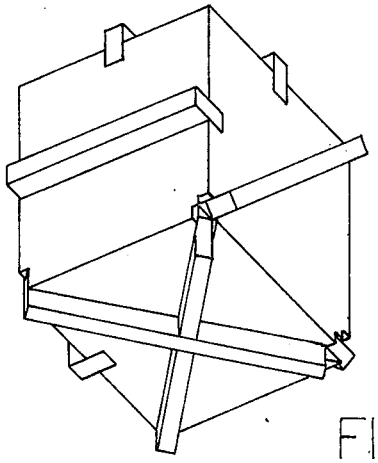
Figure 5:
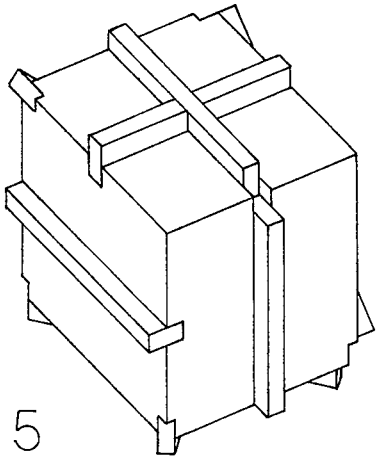
Figure 6:
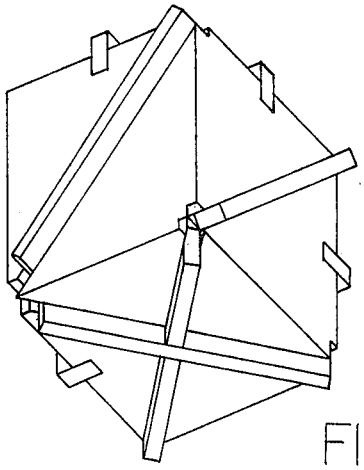
Figure 7:
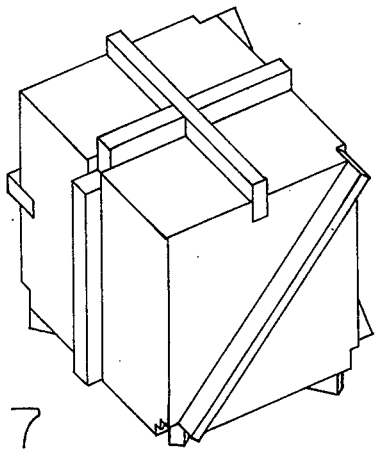
Figure 8:
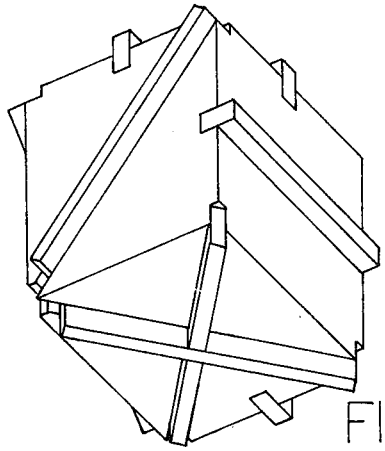
Figure 9:
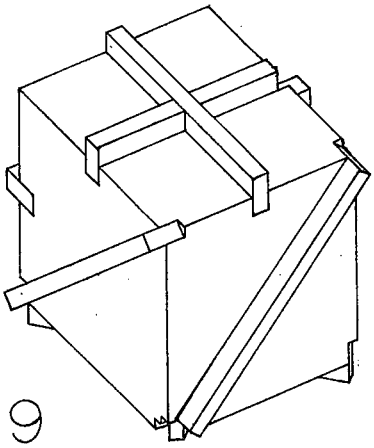
Figure 10:
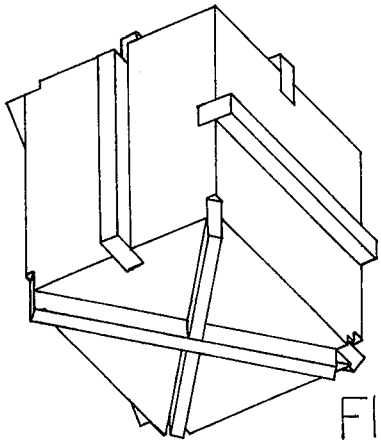

FIGS. 1, and 2. show the front, left and top; and back, right, and bottom isometric views, respectively, of the cubical playing piece which is the prototype from which the arrangements of raised strips distinguishing the six pair of duplicate pieces arise. If all twelve cubical playing pieces were of this one original arrangement, the options which introduce skill into the game would be reduced; and it would be more difficult to block an opponent, as often two opportunities to play appear simultaneously and he who played first would have the advantage. It is also impossible match the faces of two identical pieces without turning them if they happen to be alined in the same direction.

In FIGS. 3, 4, 5, 6, 7, 8, 9, and 10. without altering the cross and *x* upon the top and bottom of each piece, the raised strips on two adjacent sides have been switched one for the other on each of the four pieces described to distinguish them from the piece described in FIGS. 1, and 2.

Figure 11:
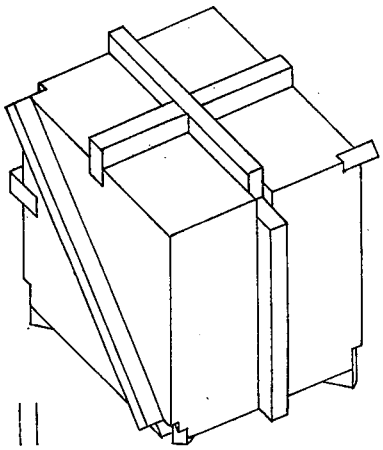
Figure 12:
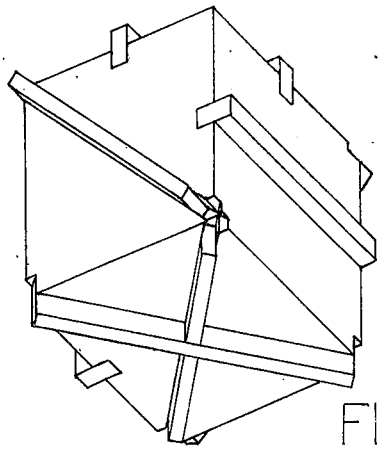

In FIGS. 11, and 12. the playing piece varys from the piece described in FIGS. 1, and 2. in one peculaiar fashion, they are the inside-out views of FIGS. 1, and 2. The directions of the two opposing diagonals have been reversed.

Figure 14:
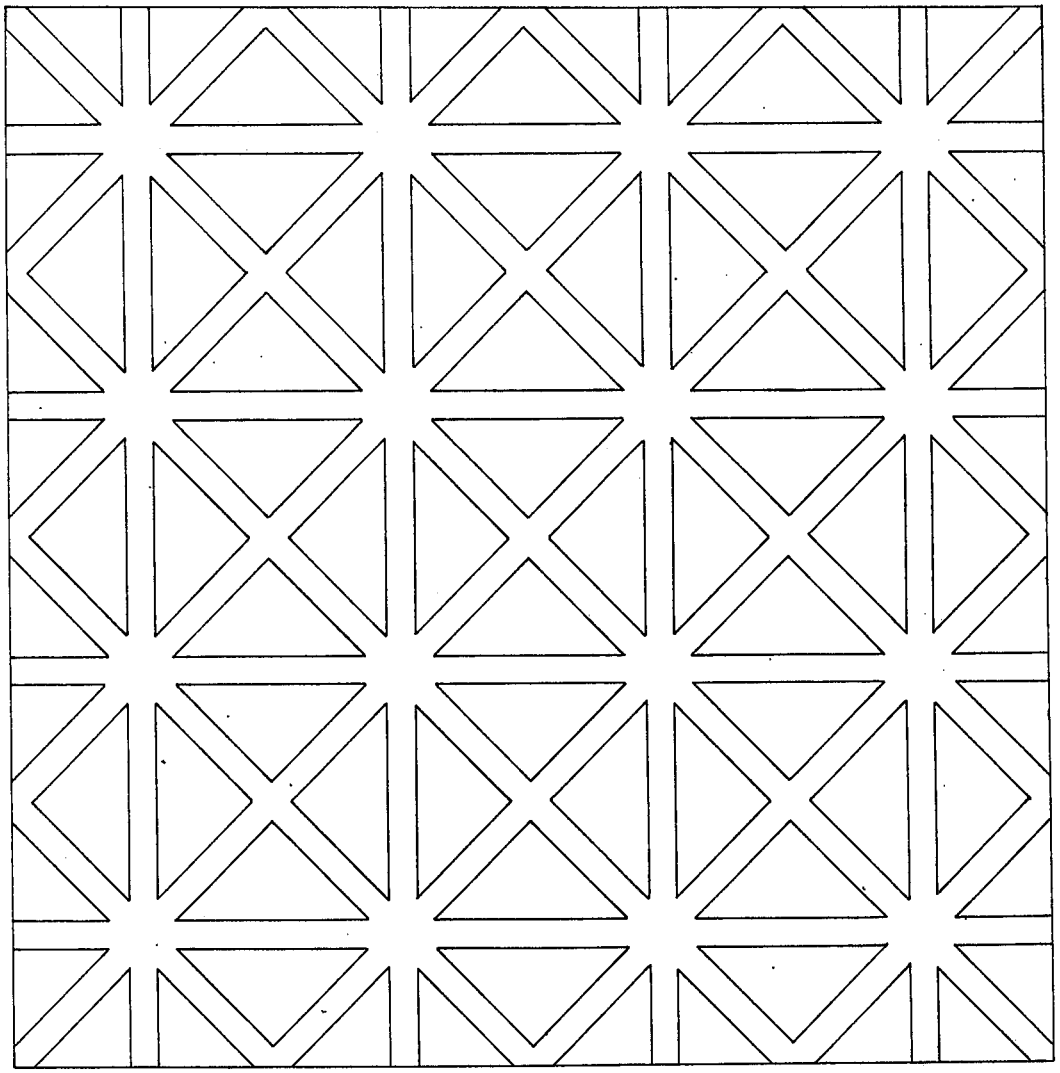
FIG. 14 is a top view of the board.
Figure 13:
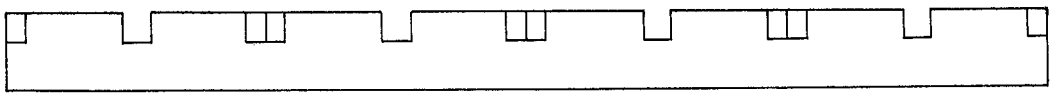
FIG. 13 is a side view of the board.
Figure 15:
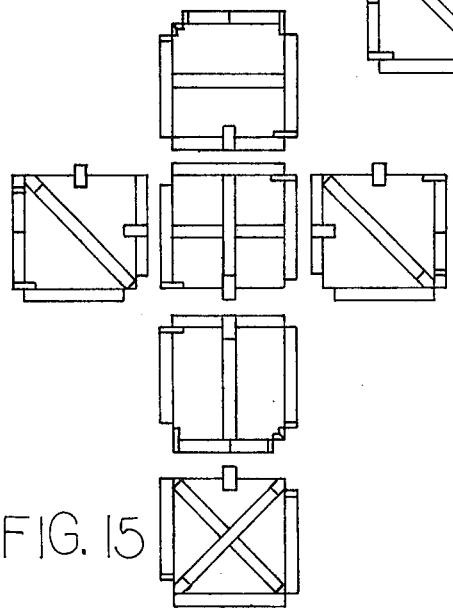
FIGS. 15, 16, 17, 18, 19, and 20. are developed, orthographic views of the six pairs of duplicate cubical playing pieces viewed in FIGS. 1, 2, 3, 4, 5, 6, 7, 8, 9, 10, 11, and 12.
Figure 16:
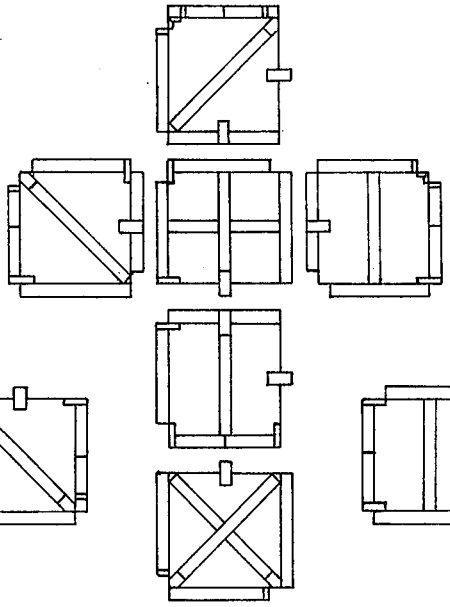
Figure 17:
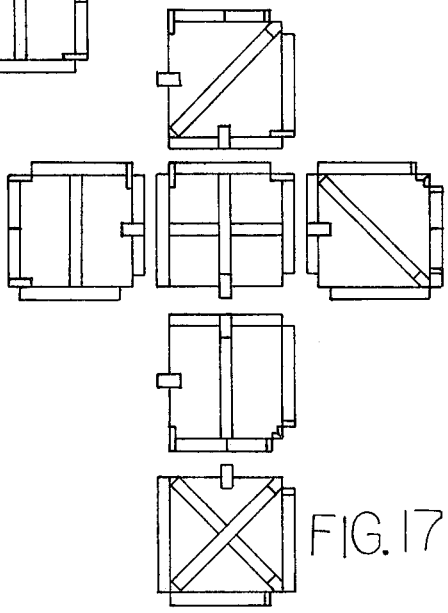
Figure 18:
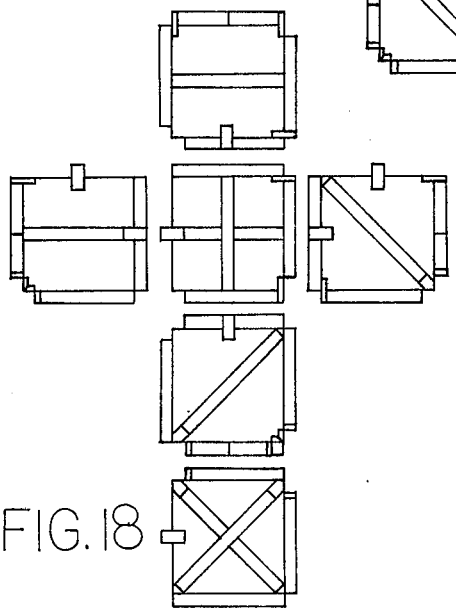
Figure 19:
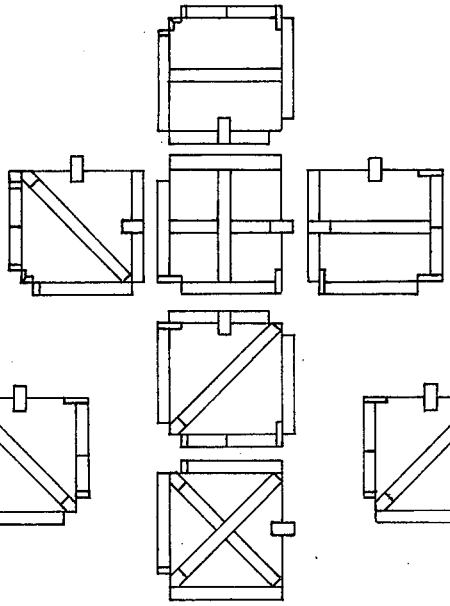
Figure 20:
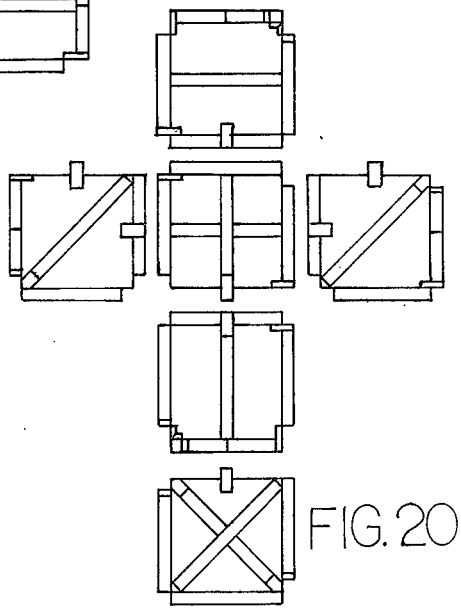

FIGS. 13, and 14 describe the playing board. There are sixteen intersections wherein eight slots meet, such that thet may receive the raised slots upon the cubical playing pieces no matter which face is down. The sixteen intersections must be spaced one from another such that when two cubical playing pieces are resting upon adjacent intersections the raised strips on the surface of the pieces will not touch. The intersections of slots in the board where only four slots meet are superfluous to the operation of the game. The slots however, must extend from the sixteen intersections the required length to receive the raised strips upon the playing pieces. The intersections where only four slots meet, exist therefore, because of the ease of manufacturing the board in such a manner.

Although the game is operable with a larger board with more intersections the limitation of using sixteen with a set of twelve playing pieces improves the quality and odds of the game.

FIGS. 15, 16, 17, 18, 19, and 20 are developed, orthographic views of the six pairs of duplicate cubical playing pieces in FIGS. 1, 2, 3, 4, 5, 6, 7, 8, 9, 10, 11, and 12.

Having thus described my invention, I claim:

1. A game comprising a playing board, evenly spaced vertical, horizontal and diagonal grooves in said playing board, said diagonal grooves arranged such that they intersect at right angles in the center of squares formed by said vertical and horizontal grooves, a plurality of identical pairs of cubical playing pieces, each edge of said cubical playing pieces having a length not greater than the length of the edges of the squares formed by said horizontal and vertical grooves, a plurality of different patterns of raised strips, each of said patterns being matable with said grooves of said playing board, each face of said cubical playing pieces having one of said plurality of patterns of raised strips provided thereon.

* * * * *